US006953395B2

(12) United States Patent
Yi

(10) Patent No.: US 6,953,395 B2
(45) Date of Patent: Oct. 11, 2005

(54) VENTILATION SYSTEM FOR UNDERGROUND STRUCTURE

(76) Inventor: Su Bin Yi, 114-201 Byeoksan Apt., 455 Hongeun-dong, Seodaemoon-gu, Seoul (KR)

( * ) Notice: Subject to any disclaimer, the term of this patent is extended or adjusted under 35 U.S.C. 154(b) by 54 days.

(21) Appl. No.: 10/746,548

(22) Filed: Dec. 24, 2003

(65) Prior Publication Data

US 2004/0137837 A1 Jul. 15, 2004

(30) Foreign Application Priority Data

Jan. 3, 2003 (KR) ..... 10-2003-0000195

(51) Int. Cl.[7] ..... F24F 7/007
(52) U.S. Cl. ..... 454/171; 454/168; 454/252
(58) Field of Search ..... 454/167, 168, 454/171, 172, 252

(56) References Cited

U.S. PATENT DOCUMENTS 5,938,527 A * 8/1999 Oshima et al. ..... 454/344
6,132,497 A * 10/2000 Conklin ..... 96/239

* cited by examiner

*Primary Examiner*—Harold Joyce
(74) *Attorney, Agent, or Firm*—Ladas & Parry

(57) ABSTRACT

A ventilation system for an underground structure which can internally supply fresh outdoor air by individually sucking and discharging air through fans of underground shafts in the underground structure such as an underground parking lot, underground warehouse, subway space, underground sporting place and underground hangar. The ventilation system for the underground structure includes air supply side fixed frames installed in air supply holes of each floor of the underground structure along one side shaft of the underground structure, air supply fans installed on the air supply side fixed frames toward the air supply holes, air exhaust rooms for forming air exhaust spaces on each floor of the underground structure, air exhaust holes being formed therein toward the other side shaft of the underground structure, air exhaust side fixed frames installed in the air exhaust rooms, and air exhaust fans installed on the air exhaust side fixed frames toward the air exhaust holes.

6 Claims, 5 Drawing Sheets

VENTILATION SYSTEM FOR UNDERGROUND STRUCTURE

BACKGROUND OF THE INVENTION

1. Field of the Invention

The present invention relates to a ventilation system for an underground structure, and more particularly to, a ventilation system for an underground structure which can internally supply fresh outdoor air by individually sucking and discharging air through fans of underground shafts in the underground structure such as an underground parking lot, underground warehouse, subway space, underground sporting place and underground hangar.

The ventilation system for the underground structure cuts down initial expenses for installing air supply/exhaust fans, fan rooms, large fans and an apparatus room, efficiently uses the underground space, reduces noises, cuts down maintenance expenses, and optimizes ventilation in the underground structure, by sucking fresh outdoor air and discharging used air on each floor with a low price and a simple structure.

2. Description of the Related Art

In general, a high-rise apartment building or high-rise building has an underground parking lot for conveniences of residents or tenants, and also has an underground warehouse in some cases. Military installations are installed underground for security.

However, air circulation is not efficiently performed by natural ventilation in the underground structure such as the underground parking lot and underground warehouse of the building and the underground military installations. Exhaust gases and other residual gases of vehicles are harmful to users. Therefore, air circulation is performed by forcible ventilation.

For example, in the underground parking lot, as illustrated in FIG. 1, shafts 1 are formed to pass through the underground parking lots on a few floors, air supply fan rooms 2 for supplying air and air exhaust fan rooms 3 for exhausting air are formed on each floor, air supply fans 2*a* for supplying air into the underground parking lot are installed in the air supply fan rooms 2, and air exhaust fans 3*a* for exhausting air from the underground parking lot are installed in the air exhaust fan rooms 3. In FIG. 1, the air supply fan rooms 2 and the air exhaust fan rooms 3 are disposed in the vertically identical positions on each floor, which is different from the real structure.

In the underground parking lot, various fans and ducts are installed to form passages between the air supply fans 2*a* and the air exhaust fans 3*a*, thereby efficiently discharging exhaust gases or other harmful gases of vehicles.

However, the air supply fans and the air exhaust fans are large-sized, to require fan rooms having a predetermined space. Accordingly, initial expenses are increased and the space of the parking lot is not efficiently used. Moreover, a lot of power is needed for the operation, noises are seriously generated, maintenance and repair expenses are increased, and the indoor environment is deteriorated.

On the other hand, 'Ventilation system for underground structure' applied for registration under Patent Application No. 10-2000-0085060 by the present applicants shows the improvements of the conventional ventilation system for the underground structure described above. FIG. 2 illustrates the ventilation system for the underground structure.

The ventilation system for the underground structure includes a duct 4 vertically installed along a shaft 1 of the underground structure, a fan 5 installed in the lowermost portion of the duct 4, for sucking air from the shaft 1 and supplying air to the duct 4, secondary nozzles 7 installed in openings formed on the wall of the shaft 1 in the underground structure side, and primary nozzles 6 installed in the duct 4 toward the centers of the secondary nozzles 7. It is intended to overcome the disadvantages of the conventional ventilation system.

However, the ventilation system is installed by connecting the nozzles to each fan, which requires a lot of power of the fans. The fans have a relatively large volume, and thus are not easily installed. In addition, noises are seriously generated. In case the fans are not operated, the whole ventilation system is stopped. That is, the whole control operation thereof is not easy.

SUMMARY OF THE INVENTION

It is, therefore, an object of the present invention to provide a ventilation system for an underground structure which can cut down initial expenses for installing air supply/exhaust fans, fan rooms, large fans and an apparatus room, efficiently use the underground space, reduce noises, cut down maintenance expenses, and optimize ventilation in the underground structure, by sucking fresh outdoor air and discharging used air on each floor with a low price and a simple structure.

To achieve the above object, there is provided a ventilation system for an underground structure including: air supply side fixed frames installed in air supply holes of each floor of the underground structure along one side shaft of the underground structure; air supply fans installed on the air supply side fixed frames toward the air supply holes; air exhaust rooms for forming air exhaust spaces on each floor of the underground structure, air exhaust holes being formed therein toward the other side shaft of the underground structure; air exhaust side fixed frames installed in the air exhaust rooms; and air exhaust fans installed on the air exhaust side fixed frames toward the air exhaust holes.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
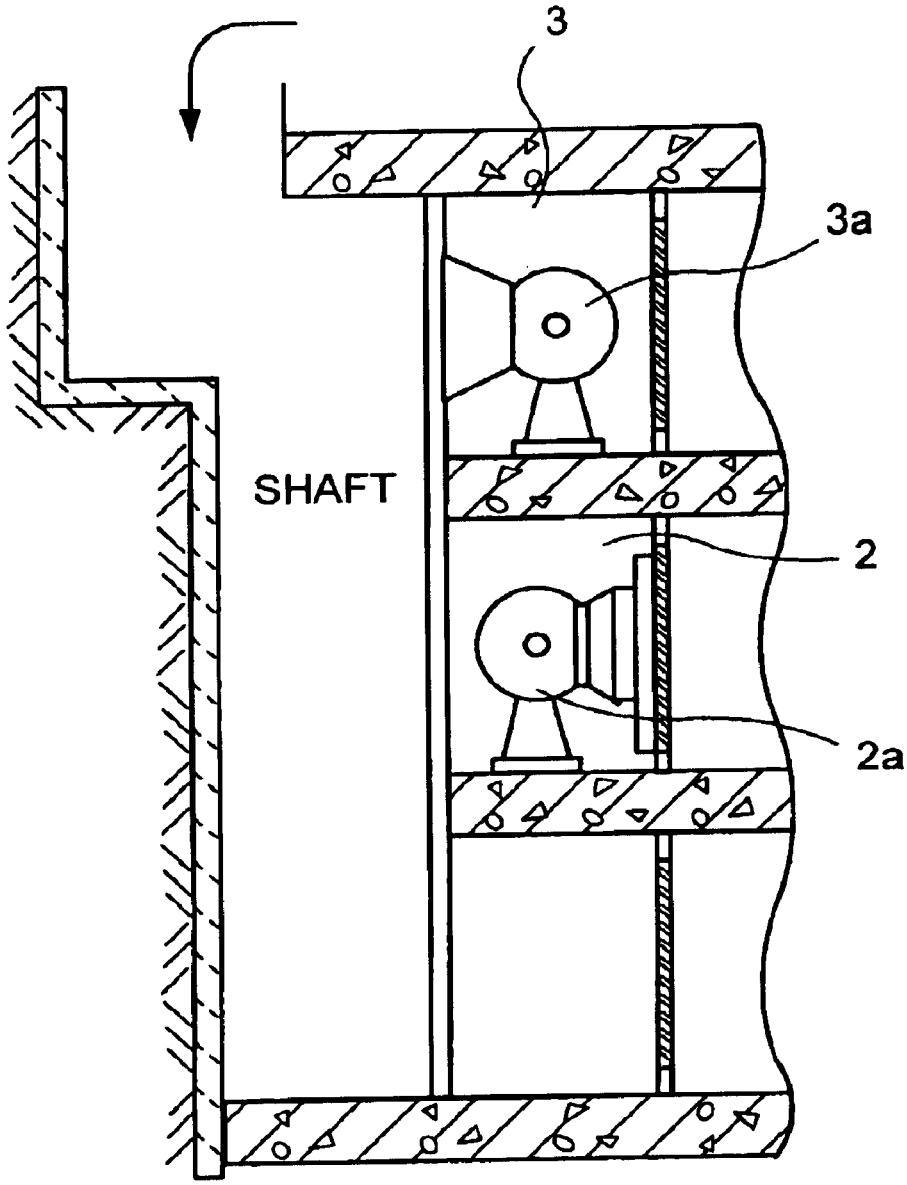
FIG. 1 is a schematic diagram illustrating a conventional air supply/exhaust system for an underground structure.
Figure 2:
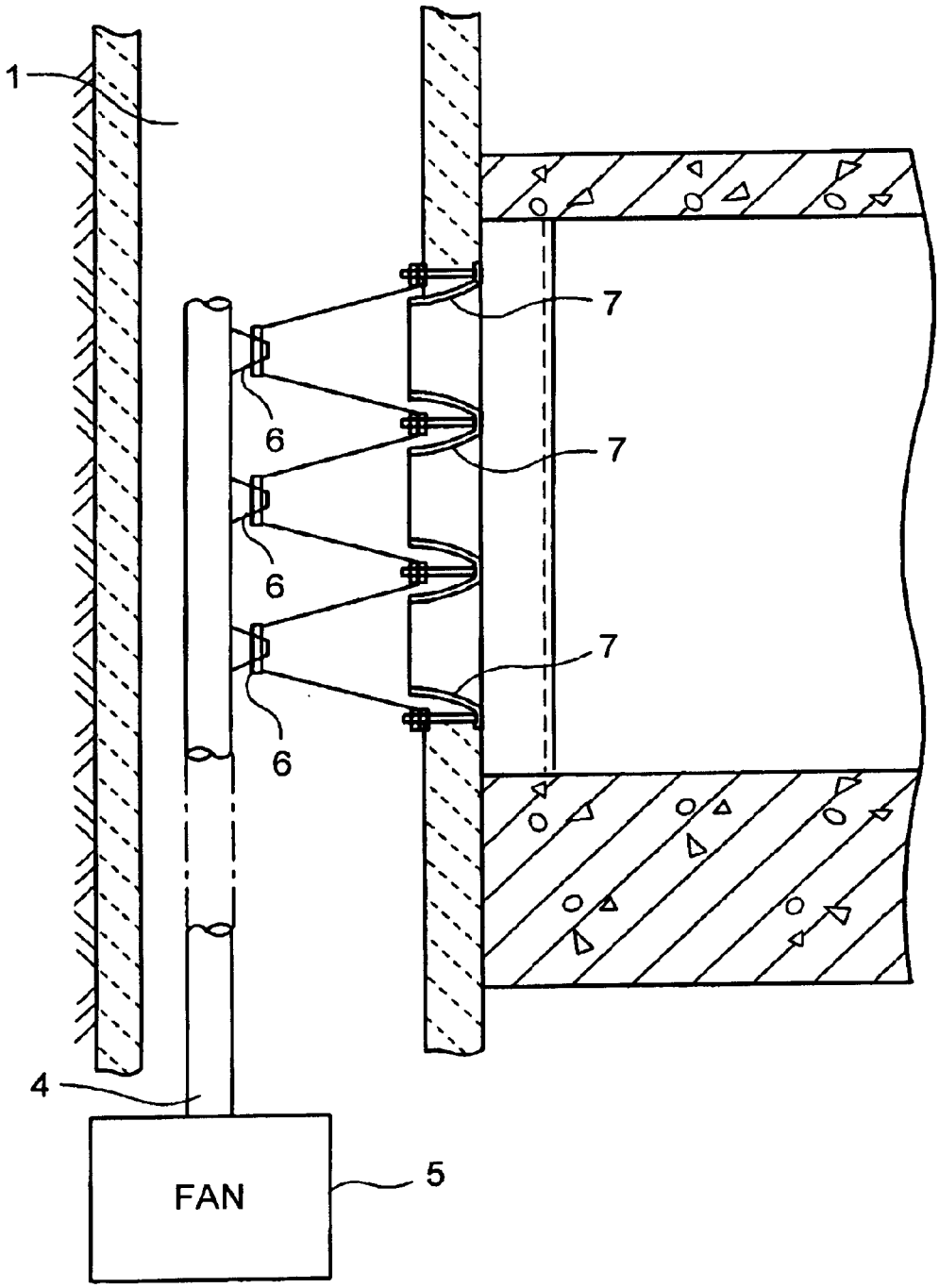
FIG. 2 is a schematic diagram illustrating a conventional air supply system for an underground structure.

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 3:
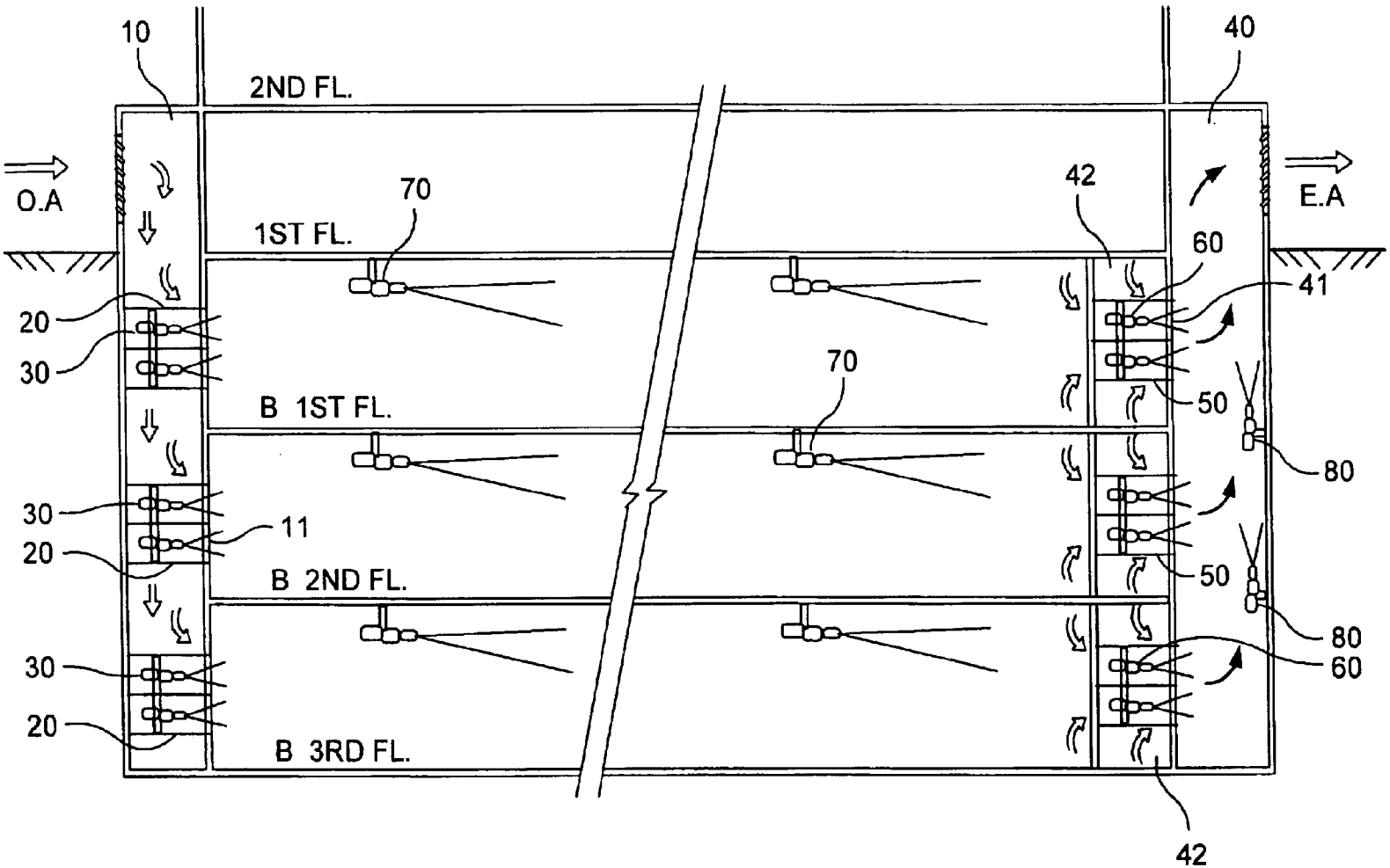
FIG. 3 is a schematic diagram illustrating a ventilation system for an underground structure in accordance with a preferred embodiment of the present invention.
Figure 4:
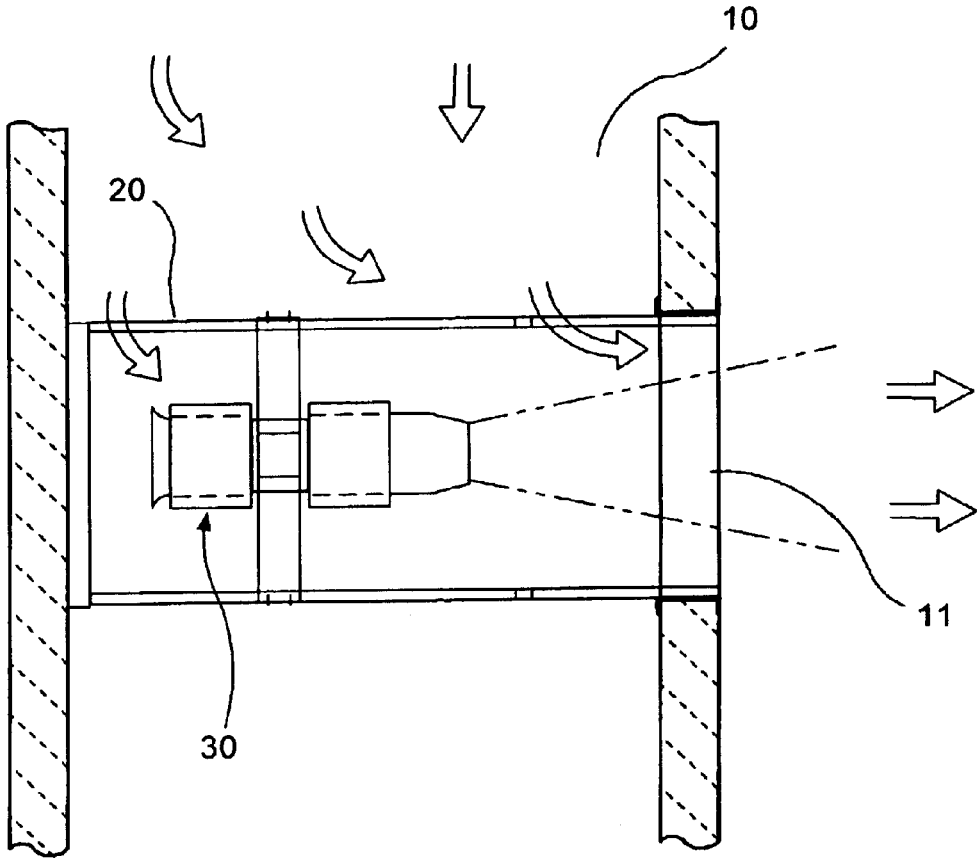
FIG. 4 is an enlarged diagram illustrating an air supply fan side of the ventilation system for the underground structure in accordance with the preferred embodiment of the present invention.

FIG. 3 is a schematic diagram illustrating a ventilation system for an underground structure in accordance with the preferred embodiment of the present invention, and FIG. 4 is an enlarged diagram illustrating an air supply fan side of the ventilation system for the underground structure in accordance with the preferred embodiment of the present invention. The ventilation system for the underground structure includes air supply side fixed frames 20 installed in air supply holes 11 of each floor of the underground structure along one side shaft 10 of the underground structure, air supply fans 30 installed on the air supply side fixed frames 20 toward the air supply holes 11, air exhaust rooms 42 for forming air exhaust spaces on each floor of the underground structure, air exhaust holes 41 being formed therein toward the other side shaft 40 of the underground structure, air exhaust side fixed frames 50 installed in the air exhaust rooms 42, and air exhaust fans 60 installed on the air exhaust side fixed frames 50 toward the air exhaust holes 41.

As illustrated in FIG. 3, special connection fans 70 for connecting flow of air between the air supply fans 30 and the air exhaust fans 60 are additionally installed in the spaces between the air supply fans 30 and the air exhaust fans 60, thereby facilitating the ventilation in the underground structure.

Figure 5:
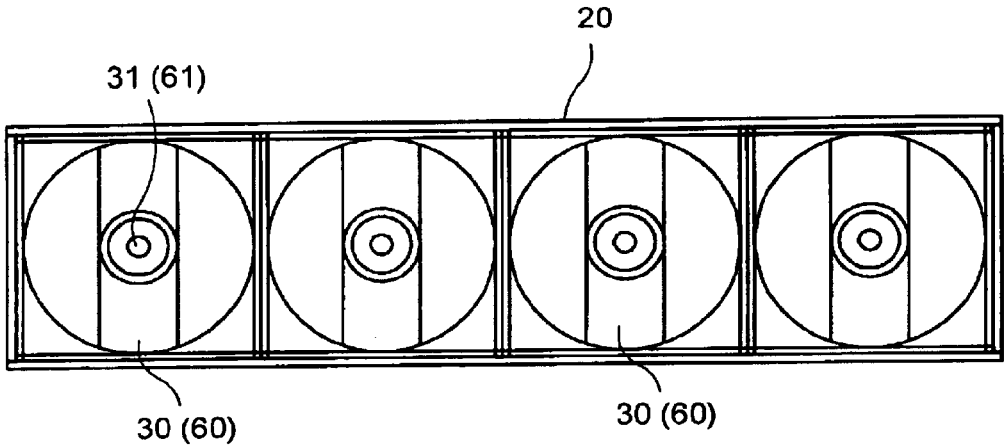
FIGS. 5 and 6 are front diagrams illustrating alignment of air supply fans and air exhaust fans of the ventilation system for the underground structure in accordance with the preferred embodiment of the present invention.
Figure 6:
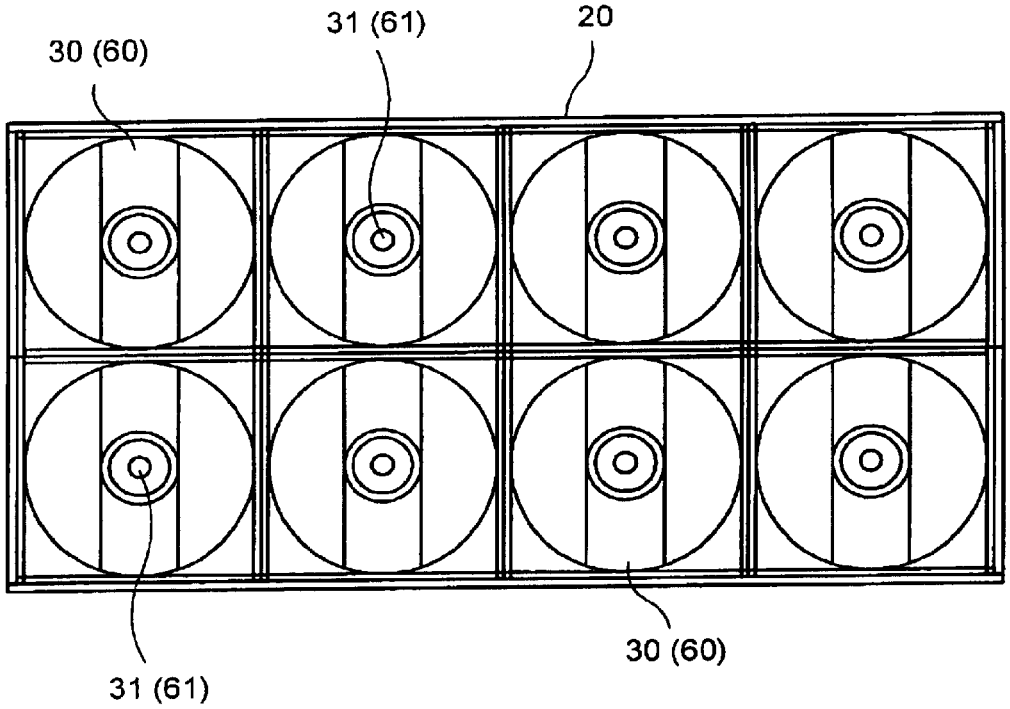

Referring to FIGS. 5 and 6, at least two of the air supply fans 30 and air exhaust fans 60 are preferably installed according to a kind of the structure. An alignment state of the fans can be controlled to have an optimum state according to a size or state of the structure.

On the other hand, display units 31 and 61 for displaying the operation states are installed on the front surfaces of each air supply fan 30 and air exhaust fan 60, so that the users can be informed of the current operation states of each fan. Accordingly, the normal or abnormal operations of the fans are displayed to always maintain proper air volume.

Preferably, the display units 31 and 61 are comprised of light emitting elements for emitting two colors of light.

In addition, an increased number of underground floors influences air exhaust performance. In this case, as shown in FIG. 3, at least one induction fan 80 is installed in the other side shaft 40 toward the upper side, so that air can flow to the upper side along the wall surface. Thus, the air exhaust performance is improved.

The operations and effects of the ventilation system for the underground structure will now be explained with reference to FIGS. 3 to 5.

The individual air supply fans 30 are disposed in one side shaft 10 of the underground structure along the air supply holes 11, and the air exhaust fans 60 are disposed in the other side shaft 40 along the air exhaust holes 41. That is, small fans are installed on-the fixed frames 20 and 50 without using ducts, thereby efficiently ventilating the underground structure.

Suction air is increased when the fans are individually installed in such free spaces rather than when they are installed in closed spaces such as ducts. As a result, the fans having smaller capacity can obtain the same effects.

In addition, the fans are installed in various types according to the structure and the ventilation request amount of the underground structure. An air supply volume is freely controlled, and the air exhaust performance is sufficiently improved to rapidly discharge poisonous gases on fire as well as accumulated air on the underground structure.

On the other hand, the smaller-sized fans reduce the installation spaces, and thus the space of the underground structure is efficiently used.

Generally, the users are not well informed of the operation states of the fans installed underground. In accordance with the present invention, the operation states of the air supply fans 30 and the air exhaust fans 60 are visually confirmed through the display units 31 and 61, so that the users can efficiently manage the fans 30 and 60. This function is very important when a large number of fans are installed as in the present invention.

Especially, the air supply fans 30 and the air exhaust fans 60 obtain the same air volume regardless of the underground depth. Therefore, the air supply fans 30 and the air exhaust fans 60 show high performance in deeper places.

While the invention has been shown and described with reference to a certain preferred embodiment thereof, it will be understood by those skilled in the art that various changes in form and details may be made therein without departing from the spirit and scope of the invention as defined by the appended claims.

As discussed earlier, in accordance with the present invention, the ventilation system for the underground structure cuts down initial expenses for installing the air supply/exhaust fans, fan rooms, large fans and an apparatus room, efficiently uses the underground space, reduces noises, cuts down maintenance expenses, and optimizes ventilation in the underground structure, by sucking fresh outdoor air and discharging used air on each floor with a low price and a simple structure.

What is claimed is:

1. A ventilation system for an underground structure, comprising:

air supply side fixed frames installed in air supply holes of each floor of the underground structure along one side shaft of the underground structure;

air supply fans installed on the air supply side fixed frames toward the air supply holes;

air exhaust rooms for forming air exhaust spaces on each floor of the underground structure, air exhaust holes being formed therein toward the other side shaft of the underground structure;

air exhaust side fixed frames installed in the air exhaust rooms; and air exhaust fans installed on the air exhaust side fixed frames toward the air exhaust holes.

2. The system of claim 1, further comprising connection fans for connecting flow of air between the air supply fans and the air exhaust fans in the spaces between the air supply fans and the air exhaust fans.

3. The system of claim 1, wherein at least two of the air supply fans and the air exhaust fans are aligned.

4. The system of claim 1, wherein each of the air supply fans and air exhaust fans comprises display units for displaying their operation states on their front surfaces.

5. The system of claim 4, wherein the display units use light emitting elements for emitting two colors of light.

6. The system of claim 1, further comprising at least one induction fan in the other side shaft toward the upper side.

* * * * *